US007144234B2

(12) United States Patent
Kiefer

(10) Patent No.: US 7,144,234 B2
(45) Date of Patent: Dec. 5, 2006

(54) FLANGED GEAR PUMP

(75) Inventor: Clément Kiefer, Basse-Ham (FR)

(73) Assignee: Pierburg, Sarl, Yutz (FR)

( * ) Notice: Subject to any disclaimer, the term of this patent is extended or adjusted under 35 U.S.C. 154(b) by 0 days.

(21) Appl. No.: 10/491,990

(22) PCT Filed: Oct. 23, 2002

(86) PCT No.: PCT/EP02/11834

§ 371 (c)(1),
(2), (4) Date: Apr. 7, 2004

(87) PCT Pub. No.: WO03/036092

PCT Pub. Date: May 1, 2003

(65) Prior Publication Data

US 2004/0265147 A1 Dec. 30, 2004

(30) Foreign Application Priority Data

Oct. 24, 2001 (FR) ..... 01 13778

(51) Int. Cl.
*F03C 2/00* (2006.01)
*F04C 15/00* (2006.01)

(52) U.S. Cl. ..... 418/132; 418/133; 418/206.1; 418/206.6; 418/206.7; 418/206.8; 418/180

(58) Field of Classification Search ..... 418/206.1, 418/206.6–206.8, 132–135, 180
See application file for complete search history.

(56) References Cited

U.S. PATENT DOCUMENTS 2,915,982 A * 12/1959 Crandall ..... 418/133
3,046,902 A 7/1962 Bobnar et al.

FOREIGN PATENT DOCUMENTS

| | | | |
|---|---|---|---|
| DE | 11 72 959 | | 6/1964 |
| FR | 1 239 211 | | 8/1960 |
| GB | 661 772 | | 11/1951 |
| GB | 1 067 552 | | 5/1967 |
| JP | 58038392 A | * | 3/1983 |
| JP | 60075783 A | * | 4/1985 |
| JP | 05248361 A | * | 9/1993 |

* cited by examiner

*Primary Examiner*—Theresa Trieu
(74) *Attorney, Agent, or Firm*—Westerman, Hattori, Daniels & Adrian, LLP

(57) ABSTRACT

The invention concerns a gear pump comprising a pump body (2) closed with a cover (3) forming a cavity wherein is provided a drive pinion (4) capable of being driven in rotation by a drive shaft (1) whereto it is fixed, a driven pinion (5) whereof the teeth co-operate with the drive pinion (4) teeth so as to be driven in rotation thereby and two end shields (8) arranged on either side of the driven pinion (5) penetrating into a cavity (10) provided therefor in the pump body (2) and the cover (3) respectively, means being provided for exerting pressure on the outer surface of the end shields. In order to prevent the cover from being deformed under the effect of the pressure thereby creating a leakage zone between the delivery zone and the suction zone, the end shields each consist of a disc (8) integral with one end of the driven pinion (5), the discs (8) and the driven pinion (5) being concentric, the discs (8) covering the teeth of the driven pinion (5). The pressure exerted on the outer surface of the discs prevents them from being deformed such that practically no axial leakage zone is formed. Additionally, the discs can serve as guiding axis for the rotation of the driven pinion.

20 Claims, 3 Drawing Sheets

FLANGED GEAR PUMP

BACKGROUND OF THE INVENTION

The present invention concerns a gear pump comprising a pump body closed by a cover forming a cavity in which is located a driving pinion capable of being driven in rotation by a driving shaft to which it is fixed, a driven pinion whose teeth cooperate with the teeth of the driving pinion so as to be driven in rotation by the driving pinion, and two flanges located on both sides of the driven pinion protruding into a cavity provided therefor in the pump body and the cover respectively, means being provided for applying a pressure to the external face of the flanges.

Such pumps are often used, in particular as oil, gas, or diesel oil pumps. Their major drawback is that the cover is susceptible to deform under the pressure existing in the discharge zone, which causes an axial play of the loose pinion. The deformation of the cover causes a leakage zone between the discharge and aspiration, so that the volume output of the pump is lowered.

Numerous documents (FR 1 239 211 A, U.S. Pat. No. 3,046,902 A, DE 11 72 959 B, GB 661 772 A, and GB 1 067 552 A) have proposed to dispose between the pinions and the casing four sliding sleeves equipped with recesses for the pinion axes. A function of these sleeves is to make the pump leak-tight by supporting the pinions. To this effect, the external faces of the sleeves are subjected to a determined pressure. In the first document, the external faces are subjected to the entry pressure of the pump, so that the risk of a reflux between the lateral faces of the pinions and the sleeves is not excluded, since the pressure existing in the discharge zone is higher than the pressure exerted on the sleeves. In the four other documents, the external faces are subjected at least in part to the exit pressure. These sleeves have a circular shape corresponding approximately to the diameter of the pinions with a flat area corresponding to the median plane between the two pinions. These sleeves are thus blocked in rotation. Further, the flat areas arranged by pairs form a junction in the area of the median plane between the two pinions, at the location where the risk of backflow is the most important.

These pumps are complicated and require a precise adjusting of the various parts, which makes them costly and fragile.

SUMMARY OF THE INVENTION

An objective of the invention is thus to develop a pump of the type of the pump presented in introduction whose cover is not at risk of deforming under the pressure and has a simpler design.

This objective is attained by the pump according to the invention in which the flanges are constituted each by a disc integral with an end of the driven pinion, the discs and the driven pinion being concentric, the discs covering the teeth of the driven pinion. Thus, the flanges rotate at the same time as the driven pinion. Only the driven pinion is equipped with flanges that cover its teeth, which makes the pumps according to the present invention simpler to manufacture. The pressure exerted on the external face of the discs which act as flanges prevent them from deforming so that practically no axial leakage zone is formed between the aspiration and the discharge as is the case in simple gear pumps. In addition, the whole zone where the teeth mesh is covered by the discs, so that no junction along the median plane between the pinions is susceptible to cause a leak. Further, the discs hem in the teeth of the pinion, which prevents an axial play of the pinions. The volume output of the pump is thus improved. The discs can have a diameter larger than the external diameter of the pinion, although this is not required.

In a preferred embodiment of the invention, the flanges act as guides for the rotation of the driven pinion. It is thus not required to have, in addition to the flanges, a guiding shaft, such as those with which pumps of the state of the art are equipped.

According to the invention, the means for exerting a pressure on the external faces of the discs comprise a first and a second space, located between the external face of the discs and the bottom of the cavity provided in the pump body and in the cover, respectively, and in which are applied approximately identical pressures. To simplify the gear pump, it is preferable that a canal crosses the driven pinion from one end to the other so that the first and second spaces communicate with each other. It is thus ensured that the two discs are subjected to the same pressure. Similarly, it is preferable that the first and second spaces are made to communicate with the discharge zone of the pump. To this effect, it is possible to design a canal or a groove that communicates with the discharge zone and at least one of the spaces.

In a preferred embodiment, the discs are hollowed out to save weight.

BRIEF DESCRIPTION OF THE DRAWINGS

The invention will be described more in details below in reference to the drawings in which.

DETAILED DESCRIPTION OF THE INVENTION

Figure 1:
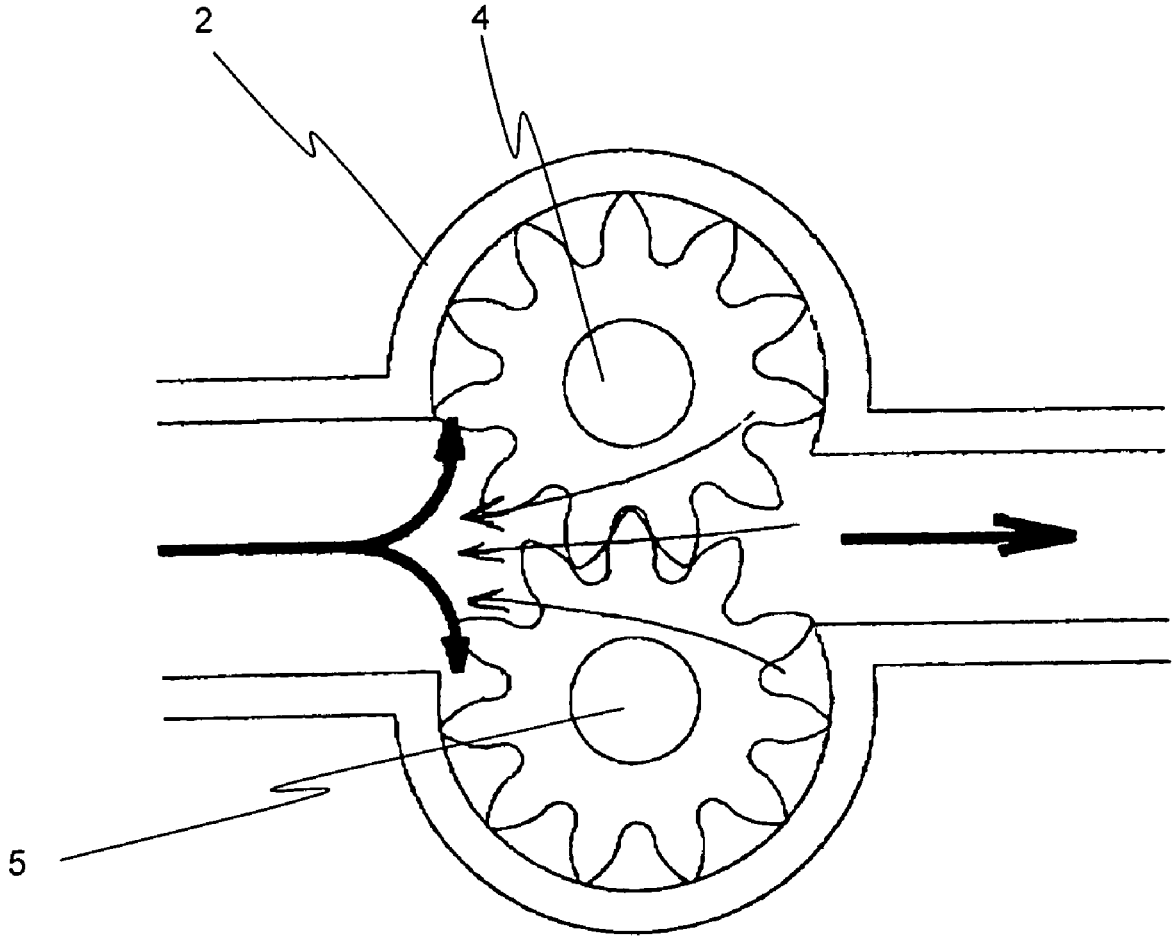
Figure 1 PRIOR ART
FIG. 1 is a longitudinal cross-section view of a gear pump.
Figure 2:
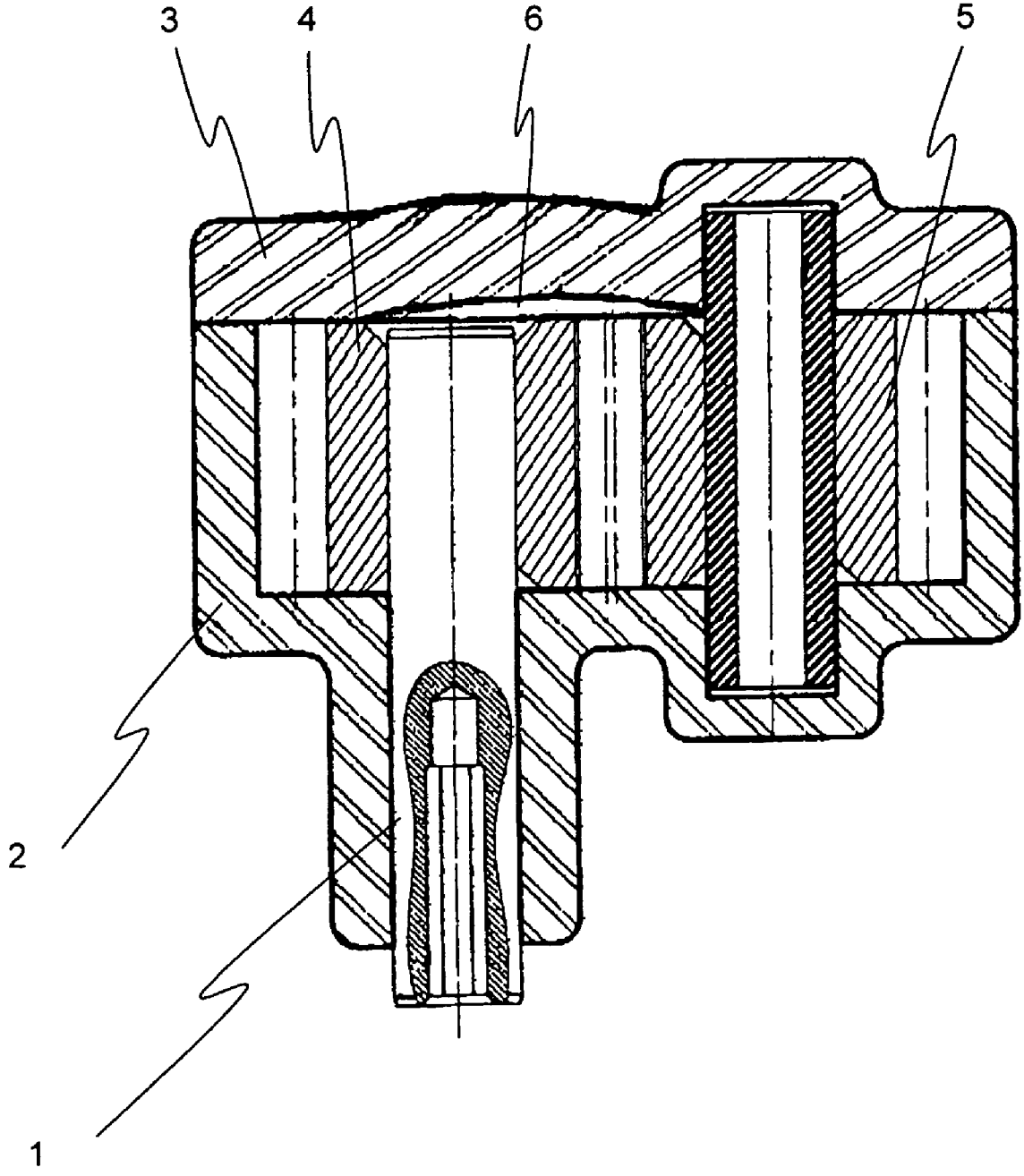
Figure 2 PRIOR ART
FIG. 2 is a transverse cross-section view of a gear pump according to the state of the art with a deformed cover.
Figure 3:
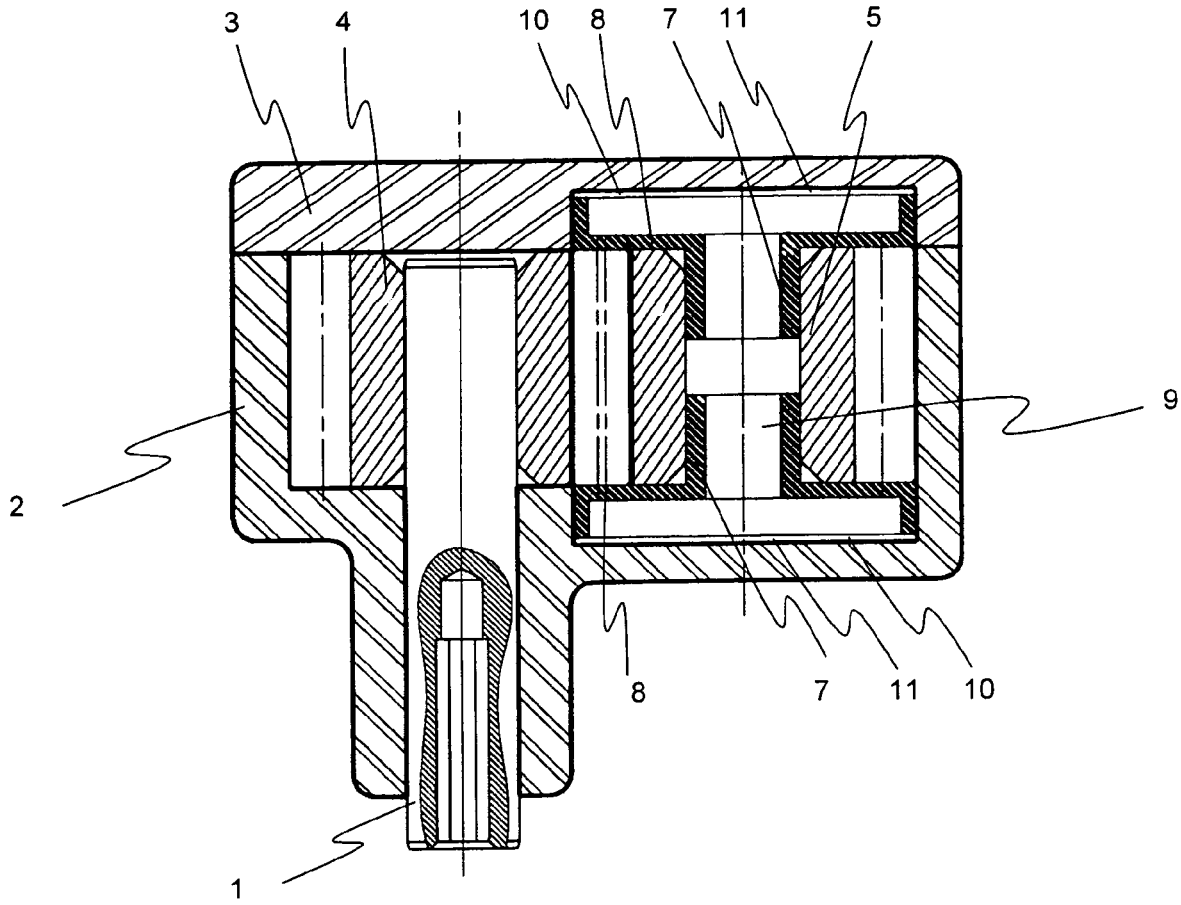
FIG. 3 is a transverse cross-section view of a gear pump according to the invention.

The gear pump according to the invention is constituted mainly by a pump body (2) closed by a cover (3) having a main cavity in which are located two pinions (4, 5) whose teeth cooperate with each other. The first pinion (4), the driving pinion, is driven by a driving shaft (1). As soon as the driving pinion (4) rotates, it drives the second pinion (5), the driven pinion. The pump has an aspiration zone on one side and a discharge zone on the other side. Under the effect of the pressure difference between the discharge zone and the aspiration zone and of the rotation of the teeth, the cover of simple pumps tends to deform, as shown on FIG. 2. There appears in that case an axial leakage zone (6) between the discharge zone and the aspiration zone, which reduces the volume output of the pump and increases the axial play of the pinions. The normal circulation of the fluid in the pump is shown on FIG. 1 in the form of thick arrows, while the fluid reflux due to the axial leakage is shown by thinner arrows.

To avoid this problem, the gear pump according to the invention is equipped with a driven pinion (5) reinforced by discs (8). At each end of the driven pinion (5) is located a disc (8) integral with the pinion and which protrudes in a cavity (10) provided to this effect in the pump body (2) and in the cover (3), respectively. A space (11) is provided between the external surface of the discs and the bottom of the cavity in which they protrude. The diameter of the discs corresponds to the diameter of the pinion, taking into account tolerances. Thus, the teeth of the driving pinion (4) are hemmed in by the discs (8) in the sensitive zone of the gear. The pressure exerted on the external face of the discs (8) prevents any deformation of the discs. This ensures fluid-tightness between the discharge zone and the aspiration zone. Indeed, no junction along the median plane between the pinions is susceptible of causing a leak, contrary to the pumps according to the state of the art. In addition, only the driven pinion (5) is equipped with flanges (8), which makes the pump according to the invention simpler and thus less expensive to manufacture.

Further, since the discs (8) are integral with the driven pinion (5), they ensure fluid-tightness even when the pressure exerted on the external faces of the discs (8) is still low, in particular when the pump is started.

The discs also fulfill a function as guiding shafts of the driven pinion (5), so that it is also possible to eliminate such a shaft, which is not the case with pumps according to the state of the art, where the flanges cannot rotate because of their very shape.

To ensure an identical pressure on both discs, a canal (9) that communicates with both cavities (10) of the discs (8) is provided.

The pressure existing on the external face of the discs (8) is exerted by the pumped fluid thanks to the communication not shown of the cavities (10) with the discharge zone. This communication can be provided in the form of a canal or a groove.

The discs (8) are made integral with the driven pinion by appropriate means (7). In order to save weight, it is preferable that the external surface of the discs (8) is hollowed out.

Thanks to the important reduction of plays, and thus the considerable reduction of leakage between the discharge zone and the aspiration zone, the volume output of the pump according to the invention is improved. Further, the discs ensure an improved stability of the pinions, which also reduces their play.

LIST OF REFERENCE NUMERALS

1 driving shaft
2 pump body
3 cover
4 driving pinion
5 driven pinion
6 leakage zone
7 fixing means of the disc
8 discs
9 canal
10 cavities
11 space

The invention claimed is:

1. Gear pump, comprising a pump body closed by a cover forming a cavity in which are located a driving pinion driven in rotation by a driving shaft to which it is fixed a driven pinion whose teeth cooperate with the teeth of the driving pinion so that the driven pinion is driven in rotation by the driving pinion and two flanges located on both sides of the driven pinion, each of said flanges protruding into a cavity provided to this effect in the pump body and the cover, respectively, means being provided for exerting a pressure on the external faces of the flanges, wherein the flanges are each constituted by a disc integral with a respective end of the driven pinion, the discs and the driven pinion being concentric, the discs covering the teeth of the driven pinion.

2. Gear pump according to claim 1, wherein the flanges act as guides for the rotation of the driven pinion.

3. Gear pump according to claim 2, wherein the means for exerting a pressure on the external faces of the flanges of the discs comprise a first and a second space between the external faces of the discs and the bottom of the cavity provided in the pump body and in the cover respectively, and in which are applied approximately identical pressures.

4. Gear pump according to claim 3, wherein a canal crosses the driven pinion from one end to the other, so that the first and second spaces are made to communicate with each other.

5. Gear pump according to claim 4, wherein the first and second spaces are made to communicate with the discharge zone of the pump.

6. Gear pump according to claim 5, wherein a canal or a groove is provided so that the discharge zone of the pump is made to communicate with at least one of the spaces.

7. Gear pump according to claim 3, wherein the first and second spaces are made to communicate with the discharge zone of the pump.

8. Gear pump according to claim 7, wherein a canal or a groove is provided so that the discharge zone of the pump is made to communicate with at least one of the spaces.

9. Gear pump according to claim 2, wherein the discs are hollowed out.

10. Gear pump according to claim 1, wherein the means for exerting a pressure on the external faces of the discs comprise a first space and a second space, each of said spaces being provided between the external face of the respective disc and the bottom of the cavity provided in the pump body and in the cover respectively, and in which are applied approximately identical pressures.

11. Gear pump according to claim 10, wherein a canal crosses the driven pinion from one end to the other, so that the first and second spaces are made to communicate with each other.

12. Gear pump according to claim 11, wherein the first and second spaces are made to communicate with the discharge zone of the pump.

13. Gear pump according to claim 12, wherein a canal or a groove is provided so that the discharge zone of the pump is made to communicate with at least one of the spaces.

14. Gear pump according to claim 11, wherein the discs are hollowed out.

15. Gear pump according to claim 10, wherein the first and second spaces are made to communicate with the discharge zone of the pump.

16. Gear pump according to claim 15, wherein a canal or a groove is provided so that the discharge zone of the pump is made to communicate with at least one of the spaces.

17. Gear pump according to claim 16, wherein the discs are hollowed out.

18. Gear pump according to claim 15, wherein the discs are hollowed out.

19. Gear pump according to claim 10, wherein the discs are hollowed out.

20. Gear pump according to claim 1, wherein the discs are hollowed out.

* * * * *